US010529547B2

(12) United States Patent
Canterbury

(10) Patent No.: US 10,529,547 B2
(45) Date of Patent: Jan. 7, 2020

(54) MASS ANALYZER DYNAMIC TUNING FOR PLURAL OPTIMIZATION CRITERIA

(71) Applicant: Thermo Finnigan LLC, San Jose, CA (US)

(72) Inventor: Jesse D. Canterbury, San Jose, CA (US)

(73) Assignee: THERMO FINNIGAN LLC, San Jose, CA (US)

( * ) Notice: Subject to any disclaimer, the term of this patent is extended or adjusted under 35 U.S.C. 154(b) by 22 days.

(21) Appl. No.: 15/993,473

(22) Filed: May 30, 2018

(65) Prior Publication Data

US 2019/0371588 A1 Dec. 5, 2019

(51) Int. Cl.

| | |
|---|---|
| ***H01J 49/40*** | (2006.01) |
| ***H01J 49/02*** | (2006.01) |
| ***H01J 49/28*** | (2006.01) |
| ***H01J 49/00*** | (2006.01) |

(52) U.S. Cl.

CPC ..... *H01J 49/022* (2013.01); *H01J 49/0031* (2013.01); *H01J 49/282* (2013.01)

(58) Field of Classification Search

CPC .... H01J 49/0031; H01J 49/061; H01J 49/426; H01J 49/427; H01J 49/4245; H01J 49/4275

See application file for complete search history.

(56) References Cited

U.S. PATENT DOCUMENTS 6,166,380 A * 12/2000 Kitagawa ..... H01J 37/28 250/307
2010/0072362 A1* 3/2010 Giles ..... H01J 49/403 250/287
2010/0193684 A1 8/2010 Mukaibatake et al.
2010/0207020 A1 8/2010 Jertz et al.
2017/0098531 A1 4/2017 Green et al.

OTHER PUBLICATIONS

Kaufmann et al, "Coalescence and self-bunching observed in commercial high-resolution mass spectrometry instrumentation", Rapid Commun. Mass Spectrom. (2018), vol. 32 (6), pp. 503-515.
Marshall et al., "Advantages of High Magnetic Field for Fourier Transform Ion Cyclotron Resonance Mass Spectrometry", Rapid Communications in Mass Spectrometry, vol. 10 (14), 1996, pp. 1819-1823.
Tarasova et al., "Ion Coalescence in Fourier Transform Mass Spectrometry: Should We Worry about This in Shotgun Proteomics?", Eur. J. Mass Spectrom. (2015), 21, pp. 459-470.

* cited by examiner

*Primary Examiner* — David E Smith
*Assistant Examiner* — Hsien C Tsai
(74) *Attorney, Agent, or Firm* — Charles B. Katz

(57) ABSTRACT

A method of operating a Fourier Transform (FT) mass analyzer, which has a plurality of selectable resolving power settings, includes storing an optimized voltage value in association with each one of the plurality of selectable resolving power settings. More particularly, the optimized voltage values for at least two of the selectable resolving power settings differ from one another. When a user selects one of the plurality of selectable resolving power settings, the optimized voltage value that is stored in association therewith is retrieved. At least one voltage setting of the FT mass analyzer is controlled, based on the retrieved optimized voltage value, and an analytical scan is performed at the selected one of the plurality of selectable resolving power settings for a population of ions within the FT mass analyzer.

25 Claims, 6 Drawing Sheets

MASS ANALYZER DYNAMIC TUNING FOR PLURAL OPTIMIZATION CRITERIA

FIELD OF THE INVENTION

This disclosure relates generally to methods and apparatus for tuning mass analyzers. More particularly, this disclosure relates to methods and apparatus for dynamic tuning of Fourier transform (FT) mass analyzers, such as an orbital electrostatic trap mass analyzer or a Fourier Transform Ion Cyclotron Resonance (FTICR) mass analyzer, using plural sets of optimization criteria.

BACKGROUND

In one version of an orbital electrostatic trap mass analyzer (commercially marketed by Thermo Fisher Scientific under the trademark Orbitrap™) ions are trapped in an orbital motion within a space between an inner, spindle-like electrode and an outer, barrel-like electrode assembly. Different ions oscillate at different frequencies within the orbital electrostatic trap, resulting in their separation over a period of time. The image current from the trapped ions, induced on the outer electrode assembly, is detected and the resulting time-dependent amplitude signal is converted to a frequency spectrum and then to a mass spectrum by processing the data in a manner similar to that used in Fourier transform ion cyclotron resonance mass spectrometry (FTICR-MS). The resolving power of an orbital electrostatic trap mass analyzer can be improved by increasing the frequency of ion motion (by, for example, increasing the strength of the electrostatic field) or by increasing the detection period, making it possible to achieve a resolving power up to at least 1,000,000 at m/z 200 using currently commercially available orbital electrostatic trap mass analyzers.

Mass analyzer systems, including orbital electrostatic trap and FTICR systems, require proper tuning in order to optimize the voltages that are applied to the various electrodes of the mass analyzer and associated ion optics. The tuning process may be performed one time only, such as for instance at the time the instrument is initially set-up. After the voltages have been optimized, according to a set of criteria, the voltages may be fixed at the optimized values. Typically, the criteria for which the voltages are optimized correspond to high-stress scenarios, e.g., highest permitted resolving power, largest permitted ion population, etc. The rationale for tuning based on high-stress scenarios criteria stems from the fact that the analytical metrics of orbital electrostatic trap and FTICR mass spectra (e.g., resolving power, signal-to-noise ratio, etc.) are determined by the trajectories of the ions that are captured in the analyzer, and how well those trapped ions adhere to certain simplified equations of motion. In particular, the longer the ions are allowed to undergo orbital motion, the better the resolving power. However, it is also generally the case that any deviations in ion motion from the idealized trajectories will be magnified proportional to the amount of time the ions spend in the analyzer. It therefore follows that if ion motion is close-to-ideal for long transients (high resolving power), then it will also be close-to-ideal for shorter transients (lower resolving power).

This traditional approach to tuning an orbital electrostatic trap or FTICR mass analyzer, using optimization criteria that are selected for high-stress scenarios, generally ignores two important realities. First, a majority of users do not operate the instrument at the highest possible resolving power settings. This is especially true in typical proteomics experiments, where the resolving power setting might be only 120,000 (at m/z 200), a factor of at least 2 less than the setting at which the instrument was tuned. Higher resolving powers are not used because the added data does not typically result in analytically useful gains for experiments in which the most important result is the number of peptide identifications. Second, any defects in the analyzer may only be apparent at the longest transient times (highest resolving power settings). Accordingly, the traditional tuning approach optimizes mass analyzer properties that are rarely or never encountered in practice when the instrument is operated using lower resolving power settings.

It would be beneficial to provide methods and apparatus that overcome at least some of the above-mentioned disadvantages and/or limitations.

SUMMARY OF THE INVENTION

In accordance with an aspect of at least one embodiment there is provided a method of operating a Fourier Transform (FT) mass analyzer having a plurality of selectable resolving power settings, the method comprising: storing an optimized voltage value in association with each one of the plurality of selectable resolving power settings, wherein the optimized voltage values for at least two of the selectable resolving power settings differ from one another; selecting one of the plurality of selectable resolving power settings; in dependence upon selecting the one of the plurality of selectable resolving power settings, retrieving the optimized voltage value that is stored in association therewith; controlling at least one voltage setting of the FT mass analyzer based on the retrieved optimized voltage value; and performing an analytical scan, at the selected one of the plurality of selectable resolving power settings, for a population of ions within the FT mass analyzer.

In accordance with an aspect of at least one embodiment there is provided a Fourier transform (FT) mass analyzer having an analyzer region within which ions are confined for mass analysis, the FT mass analyzer having a plurality of selectable resolving power settings, and the FT mass analyzer comprising: a voltage source configured to apply a voltage of adjustable amplitude to an electrode of the FT mass analyzer; and a controller, coupled to the voltage source, and being programmed to perform steps of: determining a resolving power setting of the FT mass analyzer at which an analytical scan is to be performed; retrieving from a memory store an optimized voltage value that is stored in association with the determined resolving power setting; and controlling the voltage source, based on the optimized voltage value, to apply a predetermined voltage to the electrode during the analytical scan, wherein the controller controls the voltage source to apply a different predetermined voltage to the electrode for at least two resolving power settings of the plurality of selectable resolving power settings, based on different optimized voltage values stored in association with the at least two resolving power settings and retrieved from the memory store by the controller.

In accordance with an aspect of at least one embodiment there is provided a method of tuning a Fourier Transform (FT) mass analyzer having a plurality of selectable resolving power settings, the method comprising: for each one of the plurality of selectable resolving power settings: varying at least one voltage applied to an electrode of the FT mass analyzer over a range of voltage values; recording a variation of a performance parameter over the applied range of voltage values; identifying an optimized voltage value from the recorded variation of the performance parameter using a selection criterion; and storing the optimized voltage value in association with the corresponding resolving power setting, wherein the optimized voltage values for at least two resolving power settings of the plurality of resolving power settings differ from one another.

BRIEF DESCRIPTION OF THE DRAWINGS

The instant invention will now be described by way of example only, and with reference to the attached drawings, wherein similar reference numerals denote similar elements throughout the several views, and in which.

DETAILED DESCRIPTION OF EMBODIMENTS OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein. In particular, it is to be understood that although various embodiments are discussed herein using the specific example of an orbital electrostatic trap mass analyzer, many of the same principles also apply equally well to FTICR-MS and other types of FT mass analyzers.

Throughout the disclosure and in the appended claims, the following terms shall be understood to have the following meanings.

The term "peak coalescence threshold" refers to the signal-to-noise (S/N) ratio just prior to two mass-spectral peaks of interest coalescing completely. For example, and referencing FIG. 4, in the specific case of MRFA (H-MET-ARG-PHE-ALA-OH) the two mass-spectral peaks of interest are the $^{34}S$ and the $2\times^{13}C$ peaks.

The term "isotope ratio fidelity" refers to the degree to which an experimentally observed isotope abundance ratio matches the expected isotope abundance ratio.

The term "resolving power" is defined generally as the position of a peak divided by the full width of the peak at half the maximum height (FWHM). In a mass spectrum, "resolving power" then means the mass-to-charge ratio that is assigned to a peak in a mass spectrum, divided by the full width of the peak at half the maximum height (FWHM). Resolving power is expressed as a dimensionless value.

The term "resolving power setting," which may be used interchangeably with the term "orbital electrostatic trap resolution" or "FT resolution" or simply "resolution," refers to a user-selectable operating parameter for an orbital electrostatic trap or for another type of FT-MS system. Selecting a particular resolving power setting for experimental data acquisition (i.e., an analytical scan) causes the system to detect the ion image current for a period of time that is sufficient to achieve a desired resolving power for a specific mass-to-charge value, such as for instance m/z 200. For example, typical resolving power settings for current orbital electrostatic trap systems may be 120,000, 240,000, 500,000 and 1,000,000, etc., at m/z 200. For current commercially available mass spectrometers, the operator may select one of several discrete values of resolving power settings for a particular scan, but in alternative implementations the resolving power setting may be selectable as a value lying within a continuous range of achievable resolving power.

Figure 1:
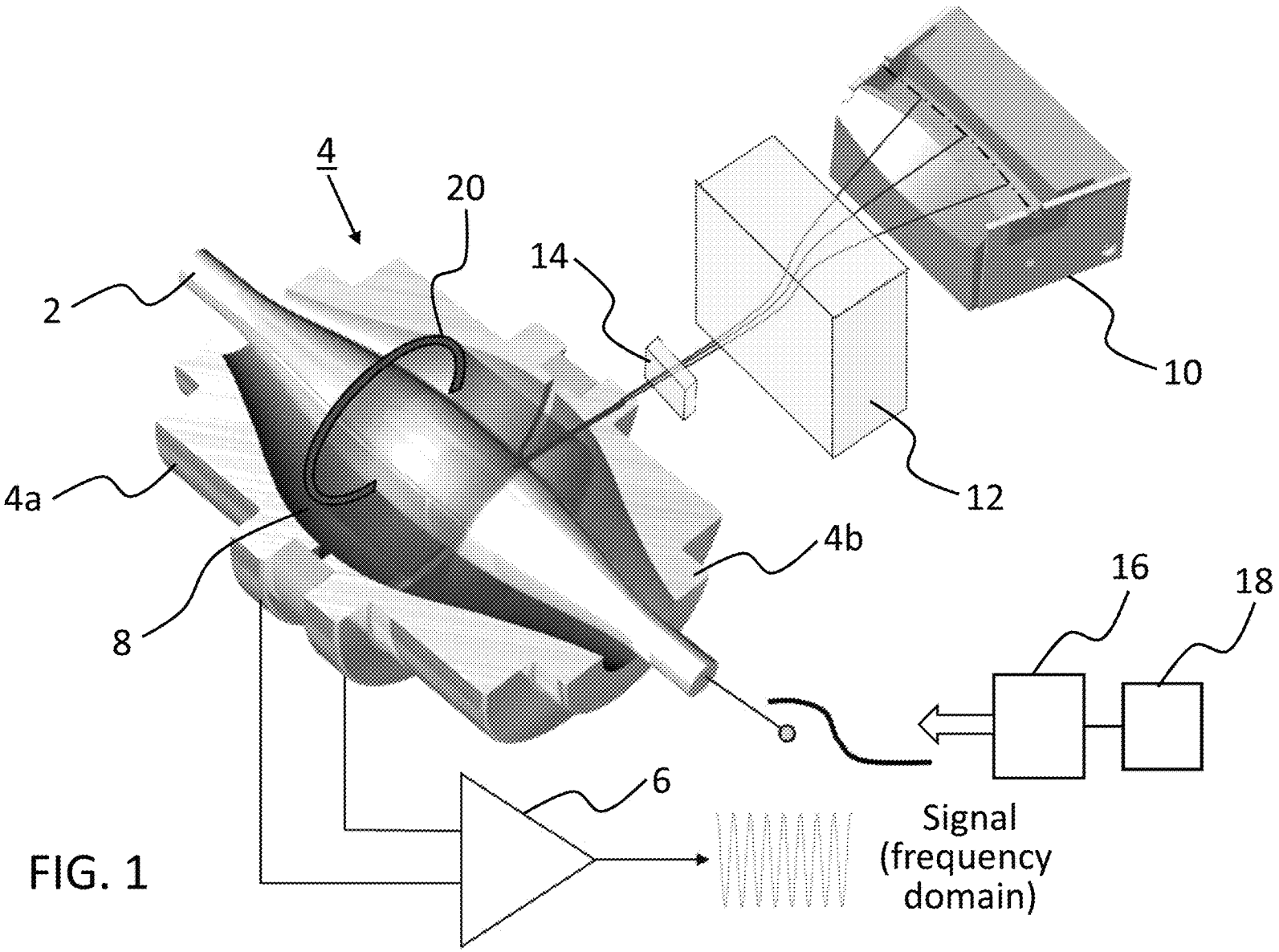
FIG. 1 is a simplified cross-sectional view illustrating the major components of an orbital electrostatic trap mass analyzer system according to an embodiment.

Referring now to FIG. 1, shown is a simplified cross-sectional view illustrating the major components of an orbital electrostatic trap mass analyzer system in which embodiments of the present invention may be implemented. As will be apparent, various housings, vacuum pumps, ion optic components, ion source components, etc. have been omitted from FIG. 1 in order to provide improved clarity. The orbital electrostatic trap electrode geometry includes a spindle-like inner electrode 2 and a barrel-like outer electrode assembly 4. The outer electrode assembly 4 is split across a central transverse plane into two symmetrical halves 4*a* and 4*b*, which are connected to a differential amplifier 6. An analytical space 8 is defined between the inner electrode 2 and the outer electrode assembly 4. During operation, ions are accumulated and thermalized in an external ion trapping device, which may take the form of a set of rod electrodes positioned generally parallel to each other and arranged around a device centerline, whereby the electrodes are curved concavely in the direction of ion ejection in order to assist spatial focusing of the ejected ions. This type of trapping device is colloquially referred to as a curved trap or C-trap and is represented in the figure as numeral 10. The ions are radially ejected from the C-trap 10 and are directed and focused into the analytical space 8 of the orbital electrostatic trap via ion optic components (e.g., electrostatic lenses), which are shown collectively at 12, and via a deflector electrode 14. A voltage source 16 applies a voltage ramp to the inner electrode 2, under the control of a controller 18, which produces an electrostatic field within the analytical space 8 that traps ions in an orbital motion 20 around the inner electrode 2. Voltage source 16 will preferably have a plurality of independently controllable output voltages, each of which is applied to a different component of the orbital electrostatic trap mass analyzer system, e.g., one of its outputs is applied to electrodes of C-trap 10, a second of its outputs is applied to ion optic components 12, a third applied to deflector electrode 14, and so on. The trapped ions induce an image current on the outer electrode assembly 4, which is amplified and discretized to produce a time domain signal representing the temporal variation of the differential charge induced on the split outer electrode. The time domain signal (referred to as a transient) may be converted to a frequency domain signal via a discrete Fourier transform algorithm (e.g., Fast Fourier transform (FFT)), and finally converted to a mass spectrum (i.e., a plot of ion abundance versus m/z values) by processing the data, using known and well-established techniques, to correlate frequencies in the frequency spectrum to m/z values.

Those skilled in the art will recognize that although voltage source 16 is indicated in FIG. 1 as a single unit, it may comprise a plurality of dedicated voltage supply devices, each providing a controlled voltage to a different one of the analyzer system components. Voltage source 16 is preferably configured to provide as output direct current (DC) voltages of adjustable value, although it may also be configured to vary the amplitude of oscillatory (e.g., radio frequency) voltages applied to one or more of the system components. Controller 18, which may form part of a larger data/control system, may consist of a combination of specialized and general-purpose processors, memory stores (i.e., devices for storage and retrieval of data, either in a transitory or non-transitory fashion), and input and output devices for receiving input from a user and displaying results or states to the user. Controller 18 may be programmed with logic (e.g., via software instructions) for executing the steps of the methods described below. The various functions of controller 18 may be distributed across multiple devices. It should be further noted that the configuration that is illustrated in FIG. 1 is intended to be a specific and non-limiting example of an FT mass analyzer in which embodiments of the present invention may be beneficially utilized, and that the invention may be employed in connection with other FT mass analyzer designs and configurations.

Traditionally, an orbital electrostatic trap mass analyzer system such as the one that is shown in FIG. 1 is tuned using optimization criteria that are selected for high-stress operating scenarios, for example with the longest allowable transient length. This is done in order to ensure acceptable operation (e.g., satisfying instrument specifications) under the widest range of operating conditions that may be encountered in practice. This approach ensures that the orbital electrostatic trap performance with respect to the optimization criteria will be no worse when it is operated using low resolving power (shorter transient) settings compared to when it is operated using maximum resolving power (longest transient length) settings. Of course, when considering resolving power-independent performance criteria, it follows that the performance of the orbital electrostatic trap will be no better when it is operated using low resolving power settings compared to when it is operated using maximum resolving power settings. As used herein, the term "performance" refers to a specific optimizable property such as, for instance, isotope ratio fidelity. For instance, because the isotope ratio fidelity typically gets worse with longer transients it is usual for the tuning procedure to be conducted using the longest available transient setting (i.e., the highest resolving power setting). In this way, the performance of the orbital electrostatic trap is optimized in terms of isotope ratio fidelity over the full range of selectable resolving power settings. However, settings that yield good isotope ratio fidelity behavior typically increase the strength of peak coupling, leading to a decrease in the peak coalescence threshold. The result is that the performance of the orbital electrostatic trap, in terms of peak coalescence threshold, may be negatively impacted for certain selectable resolving power settings.

A tailored approach to orbital electrostatic trap tuning offers the potential to improve important performance metrics when the orbital electrostatic trap is being operated using certain settings. For example, a unique set of tuning parameters may be determined for operation at low resolving power, so as to maximize the peak coalescence threshold when operating at low resolving power while keeping other metrics such as isotope ratio fidelity and signal-to-noise ratio within acceptable ranges. A separate tuning operation may be performed for every different selectable resolving power setting. However, in practice it is also possible that the same set of tuning parameters may apply to a range of different selectable resolving power settings. For instance, a first set of tuning parameters may be appropriate for resolving power settings of 120,000 and 240,000 at m/z 200, and a second set of tuning parameters may be appropriate for resolving power settings of 500,000 and 1,000,000 at m/z 200.

A multi-level tuning approach, suitable for tuning the orbital electrostatic trap mass analyzer shown in FIG. 1, may include a step of selecting a first resolving power setting of the orbital electrostatic trap analyzer. For example, the first resolving power setting may be the highest selectable resolving power setting, such as for instance 1,000,000 at m/z 200. First voltages are then applied to a plurality of electrodes of the orbital electrostatic trap analyzer to optimize operation of the orbital electrostatic trap analyzer at the first resolving power setting. Next, a second resolving power setting different than the first resolving power setting is selected. Second voltages are applied to the plurality of electrode surfaces of the orbital electrostatic trap analyzer to optimize operation of the orbital electrostatic trap analyzer at the second resolving power setting, and at least one of the first voltages is different than at least one of the second voltages. By way of a specific non-limiting example, the first and second applied voltages are determined to optimize the isotope fidelity ratio at the first and second resolving power settings, respectively. First values indicative of the first applied voltages may be stored in a non-transitory computer readable storage medium, in association with the first resolving power setting. Similarly, second values indicative of the second applied voltages are stored in the non-transitory computer readable storage medium, in association with the second resolving power setting. In practice, the first values and the second values are stored in a same tuning parameters file, which is accessible by the controller 18.

A multi-level tuning approach allows a user to shape and control the motion of ions within the mass analyzer, in order to encourage or discourage certain behavior in a way that is variably visible depending upon transient length. For example, the orbital electrostatic trap deflector voltage may be changed so as to allow ions to obtain motion that promotes better behavior with respect to peak coalescence. Although this behavior may lead to decreased performance with respect to other metrics, these other metrics may only be apparent or useful at longer transients. Thus, when the orbital electrostatic trap is operated using a lower resolving power setting, and therefore a relatively shorter transient is acquired, the affected portion of the data is effectively eliminated.

Figure 2:
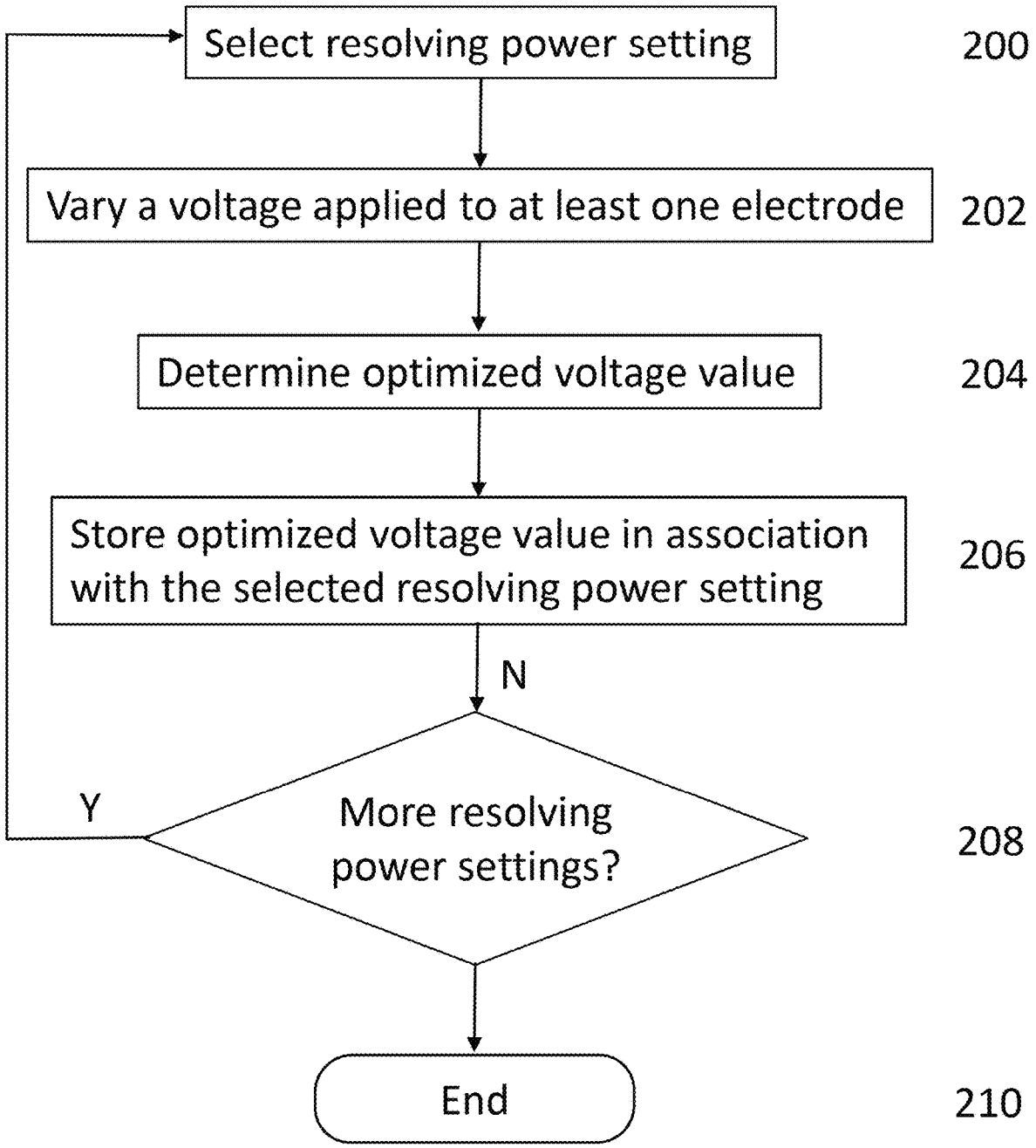
FIG. 2 is a simplified flow diagram for a method of tuning a FT mass analyzer, such as for instance an orbital electrostatic trap analyzer, according to an embodiment.

Referring now to FIG. 2, shown is a simplified flow diagram for a method of tuning a FT mass analyzer, such as for instance an orbital electrostatic trap mass analyzer, according to an embodiment. At 200 a resolving power setting of the FT mass analyzer is selected. For instance, a resolving power setting of 1,000,000 at m/z 200 is selected at 200. At 202 at least one voltage applied to an electrode of the FT mass analyzer is varied over a range of values, and the variation of a performance parameter over the applied voltage range is recorded. At 204 an optimized voltage value is determined from the recorded variation of the performance parameter using a selection criterion. At 206 the optimized voltage value is stored in association with the corresponding resolving power setting. At decision step 208 a determination is made as to whether tuning is required at additional resolving power settings. If it is determined that no additional tuning is required then the process ends at 210. If it is determined that additional tuning is required then the process returns to 200 and a new resolving power setting of the FT mass analyzer is selected, for instance, the new resolving power setting could be 500,000 at m/z 200.

The method discussed above with reference to FIG. 2 identifies and stores tuning parameters for optimizing the performance of an FT mass analyzer at each of a plurality of different resolving power settings. In this way, it is possible to achieve e.g., acceptable performance in terms of isotope ratio fidelity across the full range of resolving power settings, while at the same time improving instrumental performance in terms of e.g., charge coupling or peak coalescence threshold at some resolving power settings, relative to the performance that is observed when the traditional tuning approach is used.

Figure 3:
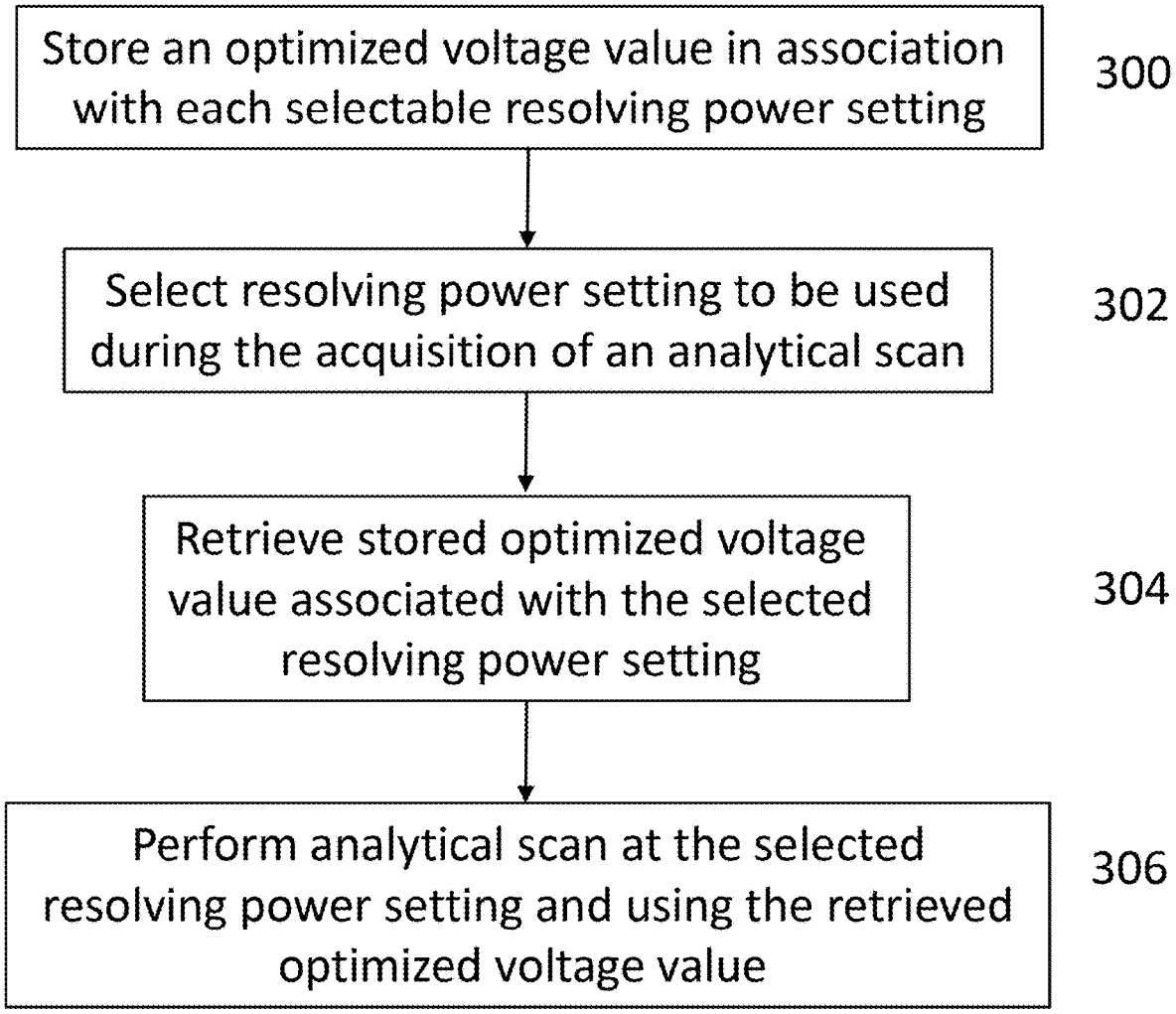
FIG. 3 is a simplified flow diagram for a method of operating a FT mass analyzer, such as for instance an orbital electrostatic trap, according to an embodiment.

Referring now to FIG. 3, shown is a simplified flow diagram for a method of operating a FT mass analyzer, such as for instance an orbital electrostatic trap, according to an embodiment. More particularly, the FT mass analyzer has a plurality of selectable resolving power settings. At 300 an optimized voltage value is stored for each one of the plurality of selectable resolving power settings. The optimized voltage value for each available resolving power setting is, for example, obtained by performing the tuning method that is discussed above with reference to FIG. 2. In practice, some of the voltages applied to some of the electrode surfaces may be common to more than one resolving power setting. At minimum, one voltage applied to one electrode—the optimized voltage value—is different for at least two of the available resolving power settings. At 302 a resolving power setting to be used during the acquisition of an analytical scan is selected. Selection of the resolving power setting typically is accomplished by entering or selecting a value within a field of a control software graphical user interface. Alternatively, a selector knob or push-button mechanism etc. may be used to make the selection. In other modes, the resolution setting may be selected in an automated or semi-automated manner dependent on other criteria, such as analyzer scan rate (i.e., the number of spectra that can be acquired per unit time). At 304 a controller of the FT mass analyzer retrieves the stored optimized voltage value that corresponds to the selected resolving power setting. At 306 the analytical scan is performed at the selected resolving power setting and using the retrieved optimized voltage value. Image current detection and data processing occur in the way that is normal for the particular FT mass analyzer.

Due to the small differences that exist between different FT mass analyzer instruments (for example, small differences between two different orbital electrostatic trap mass analyzer instruments), which result from manufacturing tolerances, environmental conditions, etc., it will normally be necessary to perform the method that is discussed with reference to FIG. 2 in order to obtain the optimized voltage values that are stored for each available resolving power setting in FIG. 3. Accordingly, it is recognized that there is a certain degree of overlap between the methods that are discussed separately with reference to FIGS. 2 and 3, and therefore it is to be understood that different steps may be performed by different individuals and/or at different times. With specific reference to FIG. 3, it is contemplated that storing an optimized voltage value for each one of the plurality of available resolving power settings at 300 may be performed by a technician during the initial set-up procedure for the instrument, whereas the analytical scan steps 302-306 may be performed days, months or even years later by an instrument operator other than the technician. Once the optimized voltage value for each one of the plurality of available resolving power settings has been determined, it is not normally necessary to repeat the tuning process unless the instrument is moved or modified, etc.

In an alternative embodiment, a "tuning curve" may be constructed using data that are acquired at a plurality of different resolving power settings. For example, an optimized deflector voltage value may be determined for achieving improved isotope fidelity performance at each of the plurality of resolving power settings, and then an optimized value may be selected for a resolving power that is intermediate two of the tuning data points by extrapolation using the tuning curve. By way of a specific and non-limiting example, a tuning curve may be constructed from data that are acquired at resolving powers of 50,000, 100,000, 250,000 and 1,000,000, and optionally saved at step 300 of the method shown in FIG. 3. A resolving power setting of 75,000 may be selected at step 302, and an optimized voltage value may subsequently be determined at step 304 by interpolating along the tuning curve between the tuning data points for resolving powers of 50,000 and 100,000.

Advantageously, changing the mass analyzer properties "on-the-fly" in the manner that is described supra does not introduce meaningful penalties in terms of analysis speed, since acquisition times (typically on the order of a few tens to several hundreds of milliseconds) are far longer than settling times (typically a few tens of microseconds) for the power supplies that are used to provide the voltages to the various electrodes in an orbital electrostatic trap system. Of course, changing the analyzer properties "on-the-fly" will necessitate the contemporaneous adjustment of other important aspects of experimental operation, such as for instance mass calibration parameters. Fortunately, such properties may be calibrated prior to running experiments and therefore this requirement also poses no significant difficulties for experimental operation.

The following examples are provided to illustrate specific and non-limiting applications in which the above-mentioned tuning process may be used to improve performance metrics of FT mass analyzers, such as for instance an orbital electrostatic trap mass analyzer.

Example 1

Figure 4:
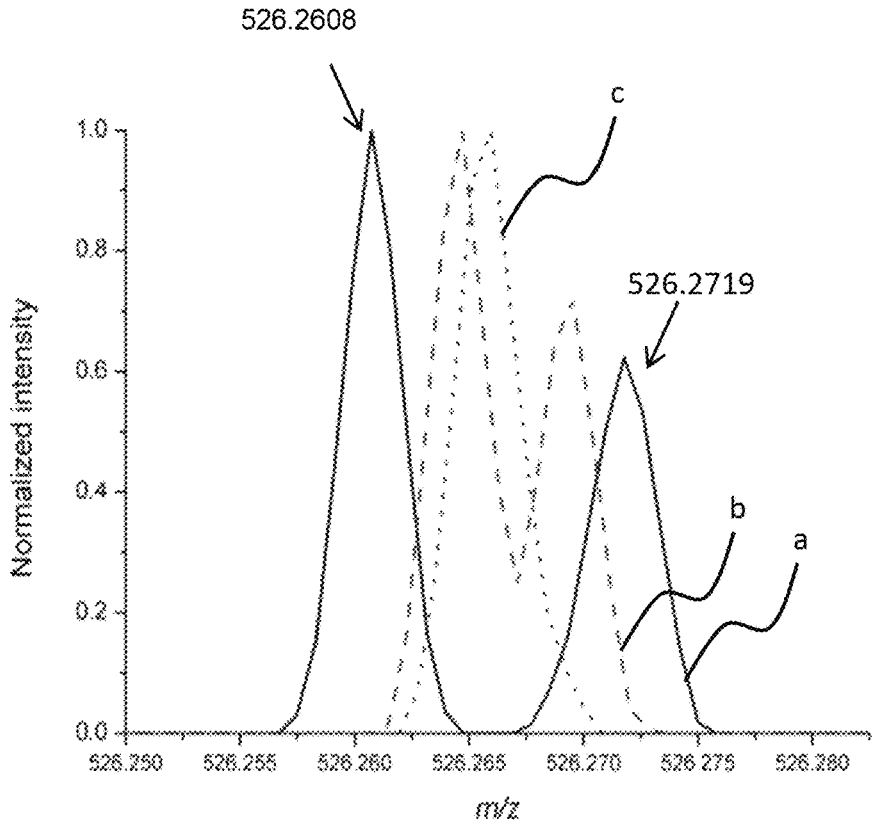
FIG. 4 is a plot showing the A+2 peak family of MRFA ($^{34}S$ vs $2\times^{13}C$) at a resolving power of approximately 148,000, when the peaks are (a) separated, (b) partially coalesced and (c) completely coalesced.

Peak coupling is known to affect the quality of the mass spectra that are obtained using an orbital electrostatic trap mass analyzer. This effect causes spectral peaks arising from ions of similar frequency to move toward each other as the number of ions associated with those peaks increases. For instance, peak coupling is observed in the isotope envelope of +1 charge states, causing even the A+3 or A+4 peaks to be shifted toward the monoisotopic peak by as much as 10-20 ppm. FIG. 4 illustrates the situation in which mass spectral peaks are very closely spaced, as in the ~11 mDa split in the A+2 peak of MRFA ($^{34}S$ vs $2\times^{13}C$). Two peaks that are separated at relatively low ion populations (solid line) begin to merge together as the ion populations increase (dashed line), and are observed to overlap completely at relatively higher ion populations and appear as a single peak in the mass spectrum (dotted line). This situation is referred to as peak coalescence.

The strength of the peak coupling effect can be changed by changing the voltages that are applied to the various electrodes in the orbital electrostatic trap mass analyzer. These voltages are typically set according to a tuning procedure that is principally concerned with optimizing the performance of the orbital electrostatic trap in terms of the isotope ratio fidelity. Isotope ratio fidelity usually decreases with longer transient periods, and therefore the tuning procedure is usually conducted at the longest available transient setting (highest available resolving power). Unfortunately, the voltage settings that result in optimum isotope ratio fidelity behavior also usually increase the peak coupling strength, which leads to a decrease in the coalescence threshold. However, at lower resolving power settings isotopic ratio fidelity may be good enough to allow for some flexibility in optimizing analyzer behavior according to other metrics, for example coalescence threshold.

Figure 5:
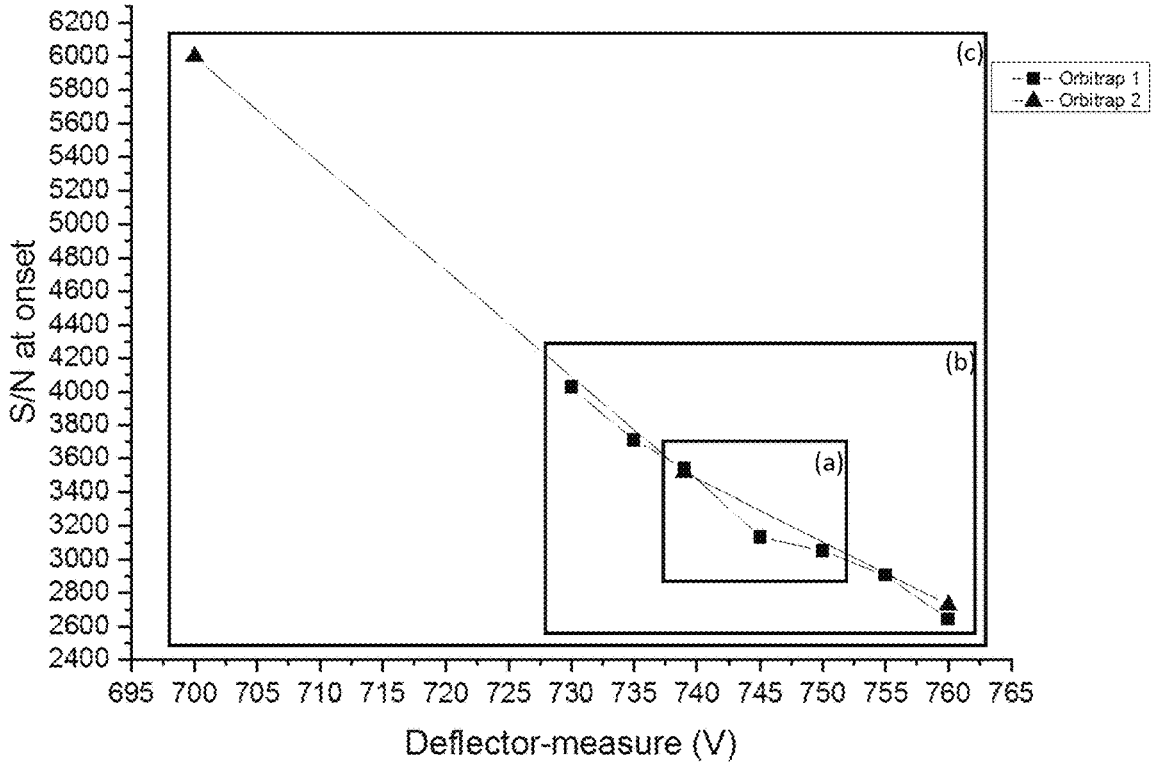
FIG. 5 is a plot showing experimentally observed peak coalescence threshold values as a function of deflector electrode voltage for two orbital electrostatic trap mass analyzers on the same instrument.

FIG. 5 illustrates how the above-mentioned tuning process may be used to improve overall orbital electrostatic trap performance for different resolving power settings. In FIG. 5 the ordinate corresponds to peak coalescence threshold and the abscissa corresponds to deflector electrode voltage. Data is presented for two different orbital electrostatic traps on the same instrument, and in each case changing the voltage that is applied to the respective deflector electrode affects the motion of the ions that are trapped within the associated orbital electrostatic trap, i.e., the radius of the orbit and the axial spread of the ions. The boxes that are drawn in FIG. 5 around the various data points denote the deflector voltage values yielding isotope ratio fidelity within specification at resolving power settings of 500,000 and 1,000,000 (box "a"), the deflector electrode voltage values with isotope ratio fidelity within specification and with the possibility of improved coalescence behavior at a resolving power setting of 240,000 (box "b"), and deflector electrode voltage values with isotope ratio fidelity within specification and with the possibility of dramatically improved coalescence behavior at a resolving power of 120,000 (box "c").

FIG. 5 shows that as the deflector electrode voltage moves away from the calibrated optimum at ~740V (for both orbital electrostatic trap analyzers), isotope ratio fidelity generally gets worse. However, the peak coalescence threshold can improve dramatically, by a factor of approximately 2 or more, when the deflector voltage is decreased from the "optimum" setting. The isotope ratio fidelity can then be improved at these smaller deflector voltage settings by acquiring a shorter transient, i.e., using a lower resolving power setting, which eliminates the portion of data in which differential isotope decay has a meaningful impact on the isotope ratio fidelity. Thus, in FIG. 5 a setting of 745V yields a coalescence threshold of 3000 and isotope ratio fidelity passes specifications at resolution 1,000,000, and a setting of 700V yields a coalescence threshold of 6000 and isotope ratio fidelity passes specification for resolution 120k. As discussed in the preceding sections, a different set of tuning parameters (i.e., deflector voltage values) could be used for orbital electrostatic trap operation at every different resolving power setting, or alternatively a different set of tuning parameters could be used for orbital electrostatic trap operation at at least some of the different resolving power settings. By way of a specific and non-limiting example, the following deflector voltage values could be used during operation of the orbital electrostatic trap analyzers that produced the data that are presented in FIG. 5: 700V for a resolving power setting of 120,000; 730V for a resolving power setting of 240,000; and 740V for a resolving power setting of 500,000 and 1,000,000.

As will be apparent, when the orbital electrostatic trap analyzers are operated at a resolving power setting of 500,000 or 1,000,000, then no improvement is expected relative to operation using the traditional tuning approach in which optimization criteria are selected for worst case scenarios. However, when the orbital electrostatic trap analyzers are operated at a resolving power setting of 120,000 or 240,000, then in this example an improvement in the peak coalescence threshold by up to a factor of two may be realized whilst still providing acceptable isotope ratio fidelity. This improvement provides a significant advantage for users who do not use the highest resolution settings on their instruments. In particular, the problem of charge states being rendered unassignable due to strong peak coupling, which causes large movements of the peaks in the mass spectrum, can be largely avoided. This is advantageous of course, since the inability to correctly assign charge states can complicate or even render inoperative downstream bioinformatics approaches that rely on correct functioning of charge state and monoisotopic mass assignment.

Example 2

Figure 6:
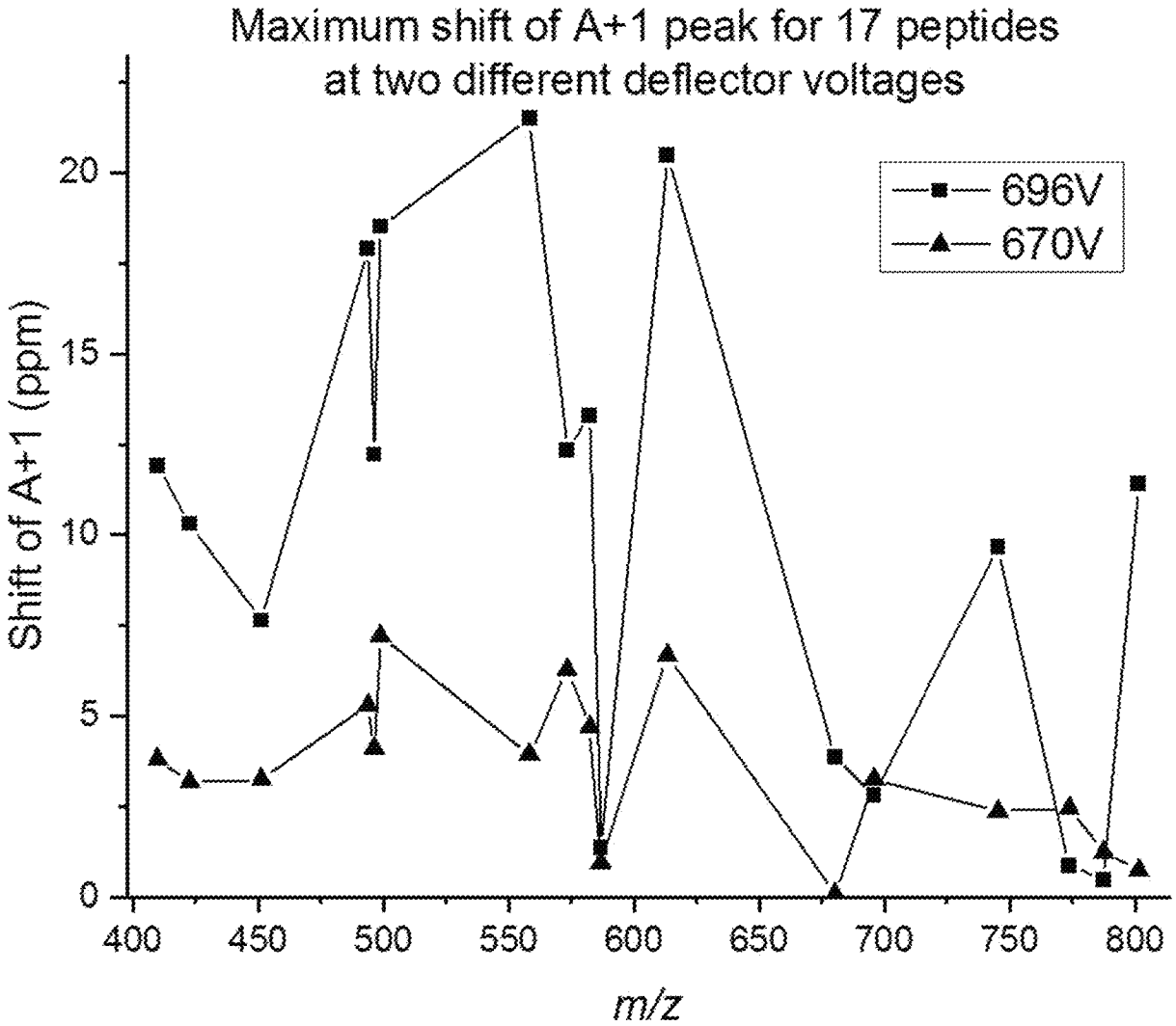
FIG. 6 is a plot showing two sets of data from an analysis of peptides acquired on a commercial hybrid mass spectrometer incorporating an orbital electrostatic trap mass spectrometer using two different deflector electrode voltage values.

Referring now to FIG. 6, shown are two sets of data from an analysis of peptides on an Orbitrap Fusion mass spectrometer at two different deflector electrode voltage values. Note that these data were taken from a different instrument than the one that was used to produce the data shown in FIG. 5. As such, the voltage values that are applied to the deflector electrode are different. In a first experiment a voltage value of 696 V was used, which corresponds to the optimized voltage value as obtained using the automated tuning routine performed in the traditional fashion (longest available transient conditions). This value yielded a coalescence threshold, as determined by the MRFA test, of about 2600. In a second experiment, after manually adjusting the voltage value that is applied to the deflector electrode to 670V, the coalescence threshold was observed to increase to 3600. Isotope ratio fidelity was slightly worse using a deflector electrode voltage of 670V, but it was still within instrument specifications. In addition, the proteomics analysis results obtained using 670 V (dashed red line in FIG. 6) were dramatically improved compared to the results obtained using 696 V (dashed black line in FIG. 6), for most of the peptides that were analyzed. That is to say, significantly smaller shifts in the A+1 peak positions were observed using a deflector electrode voltage value of 670 V compared to 696 V. In each case, the Orbital electrostatic trap was operated using the same resolving power setting. The use of a tuning parameter that was optimized for the resolving power setting that was actually selected (i.e., 670 V deflector electrode voltage) resulted in a meaningfully better instrumental performance compared to the use of a tuning parameter that was optimized for the worst-case scenario of the highest available resolving power setting (i.e., 696 V deflector electrode voltage).

Figure 7:
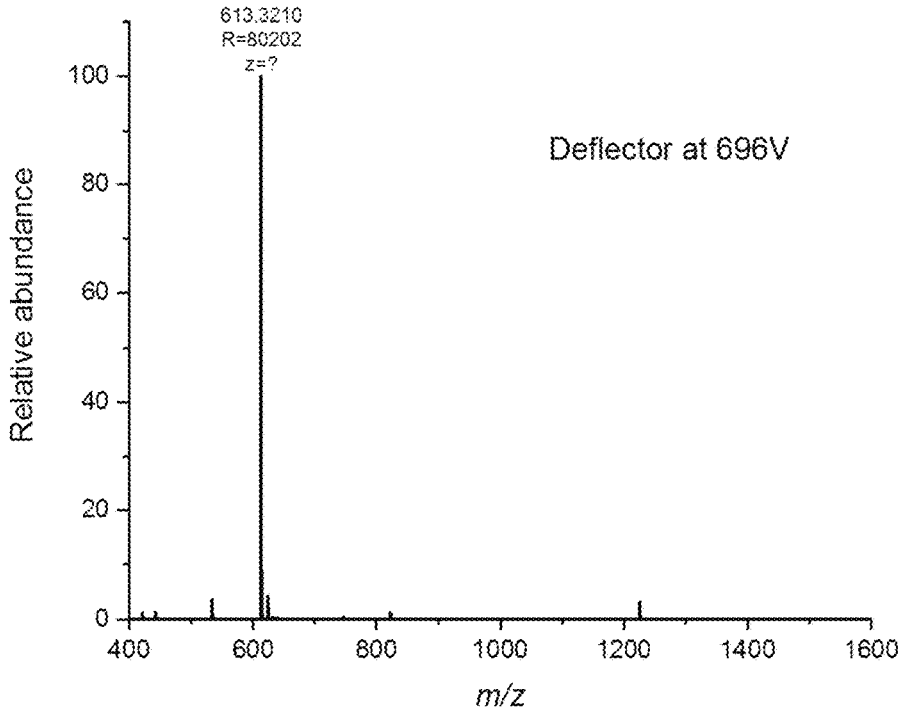
FIG. 7 shows the mass spectrum of one of the peptides represented in FIG. 6, at nominal m/z 613, with the deflector electrode voltage set at 696 V.
Figure 8:
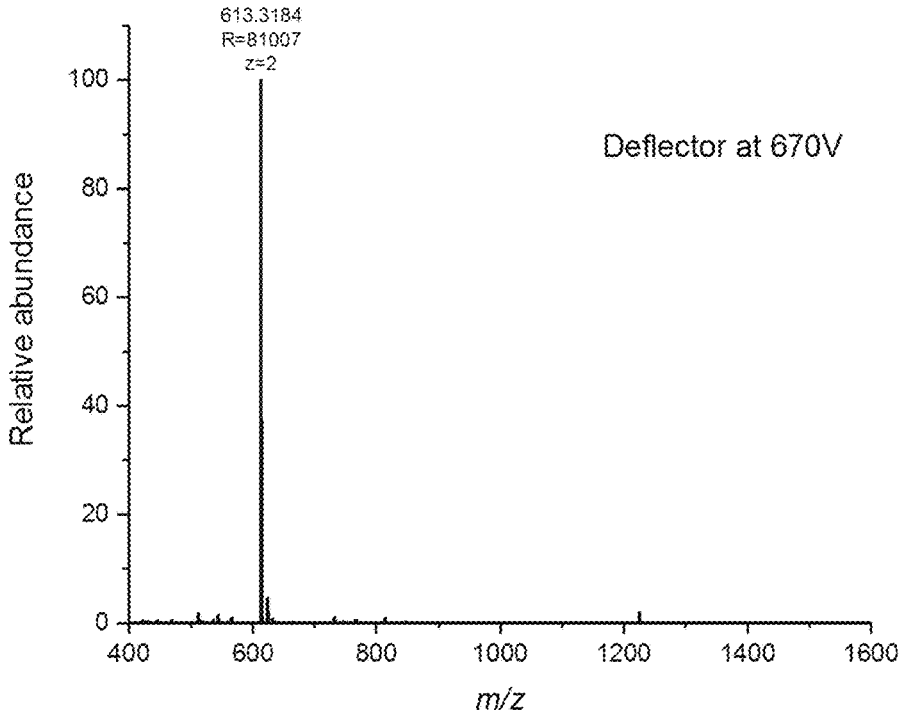
FIG. 8 shows the mass spectrum of the same peptide from FIG. 7, with the deflector electrode voltage set at 670 V.

FIG. 7 presents the mass spectrum of one of the peptides represented in FIG. 6, at nominal m/z 613, with the deflector electrode voltage set at 696 V. Similarly, FIG. 8 shows the mass spectrum of the same peptide with the deflector electrode voltage set at 670 V. Referring again to FIG. 7, the peptide is at the top of its elution profile, where signal is maximized, and the charge state is not assigned because the isotope peaks are not located close to their expected positions, causing the charge state assignment algorithm to fail. Referring now to FIG. 8, under similar conditions but using a deflector electrode voltage of 670V, the charge state is assigned correctly because the isotope peaks did not shift far enough from their expected positions to confuse the algorithm.

The preceding disclosure describes an operational scheme in which various orbital electrostatic trap ion injection and/or ion capture parameters—such as for instance the deflector electrode voltage, the injection offset (C-trap offset), lens 6 voltage, etc.—are given different values optimized to different resolving power settings. Other parameters such as ion population and mass range could also be used, and other components could be included in the list of components with different values optimized for each resolving power setting. Throughout this disclosure the selection of optimized values for different resolving power settings has been described in term of increasing orbital electrostatic trap performance with respect to peak coupling and coalescence. However, the same principles could be applied in order to improve orbital electrostatic trap performance with respect to some other key metric. Finally, while this disclosure focuses on orbital electrostatic trap instruments specifically, most FTMS instruments are operated in a similar way, with all settings remaining the same no matter the resolution, and therefore the same principles could be applied to other FTMS analyzers as well (such as FTICR-MS analyzers).

As used herein, including in the claims, unless the context indicates otherwise, singular forms of the terms herein are to be construed as including the plural form and vice versa. For instance, unless the context indicates otherwise, a singular reference, such as "a" or "an" means "one or more".

Throughout the description and claims of this specification, the words "comprise", "including", "having" and "contain" and variations of the words, for example "comprising" and "comprises" etc., mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example", "e.g." and like language) provided herein, is intended merely to better illustrate the invention and does not indicate a limitation on the scope of the invention unless otherwise claimed. No language in the specification should be construed as indicating any non-claimed element as essential to the practice of the invention.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

What is claimed is:

1. A method of operating a Fourier Transform (FT) mass analyzer having a plurality of selectable resolving power settings, the method comprising:

storing an optimized voltage value in association with each one of the plurality of selectable resolving power settings, wherein the optimized voltage values for at least two of the selectable resolving power settings differ from one another;

selecting one of the plurality of selectable resolving power settings;

in dependence upon selecting the one of the plurality of selectable resolving power settings, retrieving the optimized voltage value that is stored in association therewith;

controlling at least one voltage setting of the FT mass analyzer based on the retrieved optimized voltage value; and performing an analytical scan, at the selected one of the plurality of selectable resolving power settings, for a population of ions within the FT mass analyzer.

2. The method of claim 1, wherein the selected one of the plurality of selectable resolving power settings is a first resolving power setting and the retrieved optimized voltage value is a first optimized voltage value, and comprising:

selecting a second resolving power setting of the plurality of selectable resolving power settings, the second resolving power setting different than the first resolving power setting;

in dependence upon selecting the second resolving poser setting, retrieving a second optimized voltage value that is stored in association therewith;

controlling at least one voltage setting of the FT mass analyzer in dependence upon the retrieved second optimized voltage value; and performing an analytical scan at the selected second resolving power setting, for a population of ions within the FT mass analyzer.

3. The method of claim 1, wherein the FT mass analyzer is an orbital electrostatic trap mass analyzer.

4. The method of claim 3, wherein controlling the at least one voltage setting of the FT mass analyzer comprises applying, to an electrode of the orbital electrostatic trap mass analyzer, a voltage having an amplitude that corresponds to the retrieved optimized voltage value.

5. The method of claim 4, wherein the electrode is selected from the group consisting of: a deflector electrode and an entrance lens.

6. The method of claim 3, wherein controlling the at least one voltage setting of the FT mass analyzer comprises applying, between an electrode of the orbital electrostatic trap mass analyzer and an ion trap that releases ions thereto, an offset voltage having a magnitude that corresponds to the retrieved optimized voltage value.

7. The method of claim 3, wherein controlling the at least one voltage setting of the FT mass analyzer comprises applying a combination of voltages to a family of ion optical components, which direct and shape an ion beam prior to and at the entrance of the orbital electrostatic trap mass analyzer.

8. The method of claim 1, wherein performing the analytical scan comprises acquiring a mass spectrum of the population of ions within the FT mass analyzer.

9. The method of claim 8, wherein the population of ions comprises peptide ions.

10. The method of claim 1, wherein the FT mass analyzer is a Fourier transform/ion cyclotron resonance (FTICR) mass analyzer.

11. The method of claim 10, wherein controlling the at least one voltage setting of the FT mass analyzer comprises applying, to an excitation electrode of the FTICR mass analyzer, a voltage having an amplitude that corresponds to the retrieved optimized voltage value.

12. The method of claim 10, wherein controlling the at least one voltage setting of the FT mass analyzer comprises applying a combination of voltages to a family of ion optical components, which direct and shape an ion beam prior to and at the entrance of the FTICR mass analyzer.

13. A Fourier transform (FT) mass analyzer having an analyzer region within which ions are confined for mass analysis, the FT mass analyzer having a plurality of selectable resolving power settings, and the FT mass analyzer comprising:

a voltage source configured to apply a voltage of adjustable amplitude to an electrode of the FT mass analyzer; and a controller, coupled to the voltage source, and being programmed to perform steps of:

determining a resolving power setting of the FT mass analyzer at which an analytical scan is to be performed;

retrieving from a memory store an optimized voltage value that is stored in association with the determined resolving power setting; and controlling the voltage source, based on the optimized voltage value, to apply a predetermined voltage to the electrode during the analytical scan, wherein the controller controls the voltage source to apply a different predetermined voltage to the electrode for at least two resolving power settings of the plurality of selectable resolving power settings, based on different optimized voltage values stored in association with the at least two resolving power settings and retrieved from the memory store by the controller.

14. The FT mass analyzer of claim 13, wherein the FT mass analyzer is an orbital electrostatic trap mass analyzer.

15. The FT mass analyzer of claim 13, wherein the FT mass analyzer is a Fourier transform/ion cyclotron resonance (FTICR) mass analyzer.

16. A method of tuning a Fourier Transform (FT) mass analyzer having a plurality of selectable resolving power settings, the method comprising:

for each one of the plurality of selectable resolving power settings:

varying at least one voltage applied to an electrode of the FT mass analyzer over a range of voltage values;

recording a variation of a performance parameter over the applied range of voltage values;

identifying an optimized voltage value from the recorded variation of the performance parameter using a selection criterion; and storing the optimized voltage value in association with the corresponding resolving power setting, wherein the optimized voltage values for at least two resolving power settings of the plurality of resolving power settings differ from one another.

17. The method of claim 16, wherein the performance parameter is peak coalescence threshold.

18. The method of claim 16, wherein the FT mass analyzer is an orbital electrostatic trap mass analyzer.

19. The method of claim 18, wherein the step of varying at least one voltage applied to an electrode of the FT mass analyzer comprises varying a voltage that is applied to a deflector electrode of the orbital electrostatic trap mass analyzer.

20. The method of claim 18, wherein the step of varying at least one voltage applied to an electrode of the FT mass analyzer comprises varying a voltage that is applied to an entrance lens of the orbital electrostatic trap mass analyzer.

21. The method of claim 18, wherein the step of varying at least one voltage applied to an electrode of the FT mass analyzer comprises varying an offset voltage between an electrode of the orbital electrostatic trap mass analyzer and an ion trap that releases ions thereto.

22. The method of claim 18, wherein the step of varying at least one voltage applied to an electrode of the FT mass analyzer comprises varying a combination of voltages applied to a family of ion optical components, which components direct and shape an ion beam prior to and at the entrance of the orbital electrostatic trap mass analyzer.

23. The method of claim 16, wherein the FT mass analyzer is a Fourier transform/ion cyclotron resonance (FTICR) mass analyzer.

24. The method of claim 23, wherein the step of varying at least one voltage applied to an electrode of the FT mass analyzer comprises varying a voltage that is applied to an excitation electrode of the FTICR mass analyzer.

25. The method of claim 23, wherein the step of varying at least one voltage applied to an electrode of the FT mass analyzer comprises varying a combination of voltages applied to a family of ion optical components, which components direct and shape an ion beam prior to and at the entrance of the FTICR mass analyzer.

* * * * *